US012220091B2

(12) United States Patent
Selbekk

(10) Patent No.: US 12,220,091 B2
(45) Date of Patent: Feb. 11, 2025

(54) INCINERATING TOILET WITH A LOCKING DEVICE

(71) Applicant: Cinderella Technology AS, Midsund (NO)

(72) Inventor: Ole Selbekk, Molde (NO)

(73) Assignee: Cinderella Technology AS, Midsund (NO)

( * ) Notice: Subject to any disclaimer, the term of this patent is extended or adjusted under 35 U.S.C. 154(b) by 0 days.

(21) Appl. No.: 18/259,877

(22) PCT Filed: Feb. 18, 2022

(86) PCT No.: PCT/EP2022/054102
§ 371 (c)(1),
(2) Date: Jun. 29, 2023

(87) PCT Pub. No.: WO2022/175466
PCT Pub. Date: Aug. 25, 2022

(65) Prior Publication Data

US 2024/0065494 A1 Feb. 29, 2024

(30) Foreign Application Priority Data

Feb. 22, 2021 (NO) ..... 20210226

(51) Int. Cl.
*A47K 11/02* (2006.01)
*A47K 13/24* (2006.01)

(52) U.S. Cl.
CPC ..... *A47K 11/023* (2013.01); *A47K 13/242* (2013.01)

(58) Field of Classification Search
CPC ..... A47K 11/023; A47K 13/242
(Continued)

(56) References Cited

U.S. PATENT DOCUMENTS 3,694,825 A 10/1972 Kufrin et al.
3,867,729 A 2/1975 Helke
(Continued)

FOREIGN PATENT DOCUMENTS

BR 102018076618 A2 * 9/2019 ..... A47K 13/06
CN 111139910 A * 5/2020 ..... A47K 17/02
(Continued)

OTHER PUBLICATIONS

International Search Report issued in PCT/EP2022/054102 on Jun. 23, 2022 (3 pages).
(Continued)

*Primary Examiner* — Lori L Baker
(74) *Attorney, Agent, or Firm* — Osha Bergman Watanabe & Burton LLP

(57) ABSTRACT

An incineration toilet includes a base, a toilet unit, a seat, a toilet casing, an access opening, a cover, and a locking system. The toilet unit is secured above the base. The toilet unit includes a toilet bowl, an incineration chamber, and an ash tray. The seat has a lid around and above the toilet bowl. The toilet casing is connected to the base for protecting an outside of the toilet casing against heat from the incineration chamber. The access opening provides access to the ashtray for emptying of the ash tray. The cover is for closing off the access opening. The locking system is operable between an unlocked state in which it allows the cover to be opened and a locked state in which the cover is prevented from being opened. The incineration toilet further includes a control system for automatically operating the locking system from the locked state to the unlocked state based on a heat parameter, such that the locking system is in the unlocked state when the heat parameter is below a predetermined threshold value.

12 Claims, 7 Drawing Sheets

(58) Field of Classification Search
USPC ..... 4/111.1, 221; 110/235; 424/40, 76.1
See application file for complete search history.

(56) References Cited

U.S. PATENT DOCUMENTS

| | | | | | |
|---|---|---|---|---|---|
| 4,138,331 | A | | 2/1979 | Frankel et al. | |
| 4,521,304 | A | * | 6/1985 | Yount | A47K 11/02 210/251 |
| 4,734,943 | A | * | 4/1988 | Mellinger | E03D 5/01 4/300 |
| 8,984,679 | B2 | * | 3/2015 | Bayley | E03C 1/057 307/130 |
| D978,299 | S | * | 2/2023 | Mellberg | D23/295 |
| 11,583,148 | B1 | * | 2/2023 | Berry | A47K 13/10 |
| 2005/0071914 | A1 | * | 4/2005 | Marshall | F16K 21/16 4/427 |
| 2013/0038225 | A1 | * | 2/2013 | Brian R | H05B 47/11 315/159 |
| 2014/0230142 | A1 | * | 8/2014 | Baker | A61G 5/14 4/667 |
| 2015/0208883 | A1 | | 7/2015 | Aslaksen | |
| 2021/0161335 | A1 | * | 6/2021 | Hansen | A47K 11/023 |
| 2024/0065494 | A1 | * | 2/2024 | Selbekk | A47K 13/242 |
| 2024/0188767 | A1 | * | 6/2024 | Aslaksen | A47K 11/023 |

FOREIGN PATENT DOCUMENTS

| | | | | | |
|---|---|---|---|---|---|
| CN | 112020319 | A | * | 12/2020 | A47K 11/023 |
| CN | 212078154 | U | * | 12/2020 | A47K 11/02 |
| CN | 215166251 | U | * | 12/2021 | A47K 11/02 |
| CN | 219690677 | U | * | 9/2023 | A47K 11/023 |
| CN | 219952144 | U | * | 11/2023 | A47K 11/023 |
| EP | 2561782 | A1 | | 2/2013 | |
| EP | 2892409 | A1 | | 7/2015 | |
| EP | 3501360 | A1 | * | 6/2019 | A47K 13/06 |
| EP | 2892409 | B1 | | 4/2020 | |
| EP | 4095329 | A1 | * | 11/2022 | A47K 17/02 |
| JP | 2018027171 | A | * | 2/2018 | A47K 13/06 |
| JP | 2024082698 | A | * | 6/2024 | A47K 11/023 |
| KR | 20170015945 | A | * | 2/2017 | A47K 11/023 |
| NO | 20121008 | A1 | * | 3/2014 | A47K 11/023 |
| WO | WO-2005073476 | A2 | * | 8/2005 | E03C 1/057 |
| WO | WO-2022175466 | A1 | * | 8/2022 | A47K 11/023 |
| WO | WO-2022233551 | A1 | * | 11/2022 | A47K 11/02 |

OTHER PUBLICATIONS

Written Opinion of the International Searching Authority issued in PCT/EP2022/054102 on Jun. 23, 2022 (5 pages).

International Preliminary Report on Patentability issued in PCT/EP2022/054102, mailed on Jun. 1, 2023 (13 pages).

Written Opinion of the International Preliminary Examining Authority issued in PCT/EP2022/054102, mailed on Jan. 26, 2023 (6 pages).

Norwegian Search Report issued in No. 20210226, mailed on Sep. 20, 2021 (2 pages).

* cited by examiner

INCINERATING TOILET WITH A LOCKING DEVICE

FIELD OF THE INVENTION

The present invention relates to an incinerating toilet with a locking device.

BACKGROUND OF THE INVENTION

An incinerating toilet comprises a toilet unit which in turn comprise the essential components of the toilet; a toilet bowl, an incinerating chamber and an ash tray for storing ashes from the combustion. The toilet unit is also referred to as the "inner part" of the incinerating toilet. Due to the high temperature of the combustion chamber, the incinerating toilets are often made with a toilet casing covering the toilet unit, in order to insulate the toilet towards the surroundings. The toilet casing provides in addition a better esthetic appearance.

The toilet casing can be divided into different sections that can be opened for inspection, service and maintenance of the toilet unit located behind the toilet casing. Known in the prior art is an incinerating toilet comprising a hatch for emptying of the ash tray, in addition to inspection, service and maintenance. The opening of the hatch is arranged in front of the toilet and towards the lower part of the toilet.

Publication EP 2892409 B1 discloses an incineration toilet comprising a base, waste bowl, incineration chamber and an ash tray arranged as the lower part of the incineration chamber. The ash tray can be accessed through an access opening provided when the toilet casing is lifted. The access opening being closeable by the toilet casing. The disadvantage of this system is that the toilet casing can be lifted even when the temperature inside the toilet is high, this may potentially cause harm or injury to the user when exposed to the heat.

One object of the present invention is to improve the safety of the incinerating toilet.

SUMMARY OF THE INVENTION

The present invention relates to an incineration toilet comprising a safety arrangement that prevents the user to be exposed to heat from the incineration chamber that can cause harm or injury to the user.

The present invention relates to an incineration toilet comprising:

- a base,
- a toilet unit secured above the base, wherein the toilet unit comprises a toilet bowl, an incineration chamber and an ash tray,
- a toilet casing connected to the base for protecting an outside (OS) of the toilet casing against heat from the incineration chamber,
- an access opening through which access to the lower parts of the toilet unit is provided,
- a cover for closing off the access opening, and
- a locking system operable between an unlocked state in which it allows the cover to be opened and a locked state in which the cover is prevented from being opened.

The incineration toilet further comprises a control system for automatically operating the locking system from the locked state to the unlocked state based on a heat parameter, such that the locking system is in the unlocked state when the heat parameter is below a predetermined threshold value.

The locking system may be operated from the unlocked state to the locked state based on user interaction.

The control system may be operating the locking system from the unlocked state to the locked state based on input from a user via a user interface.

The ash tray may be arranged as the bottom section of the incineration chamber, and wherein the ash tray is removeable so that it can be disconnected and removed for cleaning and emptying when necessary. The ash tray is accessible through the access opening after opening or removing the cover.

The access opening may be provided as an opening in the toilet casing, or the access opening may be provided by moving the entire toilet casing as disclosed in EP 2892409 B1. The cover being arranged to close off the access opening of the incineration toilet. The cover may be moveable from a closed position covering the access opening and an open position not covering the access opening. The cover may be a hatch, plate, lid, section of the toilet casing, or the entire toilet casing.

According to the present invention, the cover may only be moveable from the closed position to the open position, in the event the locking system is in the unlocked state.

In operation, the cover is in the locked state and thus prevented from being opened. Upon user activation, i.e., by pressing a button or a control panel (in that the user want access to the inner parts of the toilet), the control system reads the heat parameter and compares it with the predetermined threshold value. In the event the heat parameter is above the threshold value, the control system does not allow the cover to be opened, but in the event the heat parameter is below the threshold value, the control system automatically operates the locking system from the locked to the unlocked state such that the cover can be opened to allow access through the access opening.

The locking system may comprise a locking element arrange to engage with the cover in the locked state, wherein the locking element is disengaged from the cover in the unlocked state.

The locking element may be connected to the toilet unit or the toilet casing, and the cover may comprise a recess or a locking aperture for cooperation with the locking element in the locked state.

The locking element may be a bimetal element. The bimetal work with the property of metals to expand when heated, and contract when cooled. The resulting change of curvature, or bending, in response to temperature change, is a fundamental property of all thermostatic bimetals. In effect, the temperature change is converted into mechanical displacement such that the bimetal may move the locking element of the locking system from the locked state to the unlocked state. Hence, the bimetal element is both a sensor and an actuator.

The behaviour of bimetals is predictable and repeatable. The components used for bimetals are selected for their temperature characteristics as well as their thermal conductivity, stability, strength, workability, and electrical properties. It is within the scope of the invention to select any bimetal suitable for the purpose of the present invention.

The locking system may comprise at least any one of a heat sensor for measuring the heat parameter and/or a timer for calculating the heat parameter.

The control system may receive information about the state of the locking system from a sensor.

In embodiment, the locking system comprises the heat sensor or a temperature sensor for measuring the temperature at the inside of the incineration chamber and/or at the lower parts of the toilet unit.

The heat sensor may be a K-sensor. The type K thermocouple refers to any temperature sensor containing Chromel and Alumel conductors. This may be an immersion sensor, a surface sensor, wire or another style of sensor or cable.

The heat sensor measures the temperature inside the toilet and/or inside the incineration chamber/ash tray and communicates with the control system for comparison with the temperature threshold value. The temperature threshold value may be set to any temperature. Preferably, the threshold value temperature is set to a temperature that potentially causes less or minimal harm to the user.

The temperature threshold value may be set to 60° C. (degree Celsius), and the control system prevents the cover from being opened in the event the temperature inside the toilet is above 60° C.

The temperature 60° C. may be preferable since the user may normally not experience extreme burns when exposed to heat at this temperature. As mentioned above, other temperatures may also be appropriate depending on the safety requirements.

The locking system may comprise a timer for calculating the temperature at the inside of the incineration chamber and/or at the lower parts of the toilet unit based on time elapsed since last incineration and a cooling time of the incineration chamber. Based on experience and tests, the cooling time of the incineration chamber can be predicted with reasonable accuracy. Thus, the temperature at the lower parts of the toilet and/or the ash tray/incineration chamber can be calculated based on the time elapsed since last incineration process. The control system may compare the calculated time with a predefined threshold value, so that the locking system may be operated between the locked and the unlocked state in the event the heat parameter is below the threshold value.

In embodiment, the locking system is in the locked state during operation and stand by. The user may indicate on a press button or on a control panel that he wishes to gain access through the access opening, i.e., for emptying of the ash tray. Upon activation of the opening command, the control system reads whether the heat parameter is below the threshold value. In the event the heat parameter is below the threshold value, the control system will allow the cover, covering the access opening, to be opened. This may be done by the control system releasing the cooperation or engagement between the locking element and the cover.

In embodiment, the heat sensor and/or the timer may be connected to the control system configured to compare the temperature measured by the heat sensor and/or the timer with the predetermined threshold value.

The locking system may comprise an actuator with an actuator element movable between a first position defining the locked state and a second position defining the unlocked state.

The actuator may be secured to an inside of the toilet casing or to the toilet unit, wherein the actuator element may be engaged to the cover in the locked state and where the actuator element disengaged from the cover in the unlocked state.

The actuator may be controlled by the control system.

The actuator may be an electromagnet acting on the actuator element. The actuator element may be spring loaded, so that the electromagnet may be in an off position when the actuator is in the lower position (released spring position), referred to as the locked state. In the event the cover is in a position covering the access opening (closed position), the cover will push the spring-loaded actuator element such that it engages the locking aperture on the cover. The spring-loaded actuator may preferably have a shape that allows guidance and/or easy cooperation with the cover when the cover is pushed into position. The locking system is thus in the locked state, and this may the normal state during use and standby.

The system may comprise a location sensor/switch for reading the locked state and that the cover is in the locked position. The sensor/switch may be activated by a spring being compressed by the cover in the event the cover is in position covering the access opening.

In the event access through the access opening is desired, the control system reads (checks) whether the temperature in the incineration chamber and/or the lower parts of the incineration toilet is below the threshold value so that there is no danger of burns by touching the ash tray. If the temperature is below the threshold value, the user may be allowed to open the cover.

The electromagnet may have a pulse of about one second and attract the actuator element vertically, or substantially vertically, so that it can be released from cooperation with the recess or locking aperture provided on the cover. The spring is tensioned towards the cover and will push the cover outwards in the event the cover is released from the actuator element. The cover may remain in a semi-open position (i.e., by a spring or magnet) so that the actuator element is prevented to return to engagement with the opening or locking aperture on the cover. The actuator element will be forced into engagement with the recess or locking aperture when the cover is pushed back into position covering the access opening and the spring will again be tensioned (loaded) towards the cover.

In embodiment, the sensor/switch reads the position of the cover via the spring and sends the information to the control system indicating the locked or unlocked state of the locking system. Thus, in the event the cover is installed in a position covering the access opening, the sensor/switch will be activated by the cover pushing (biasing) the spring of the sensor/switch backwards or inwards.

The incineration toilet of the present invention may comprise a main locking system and a secondary locking, wherein the locking system of the present invention is the main locking system. The secondary locking system may be a system allowing the opening of the cover mechanically, by a magnet, spring or push button. The second locking system may only function in the event the main locking system is in the unlocked state. In the event the main locking system is in the locked state, the secondary locking system cannot be operated so that the cover is prevented from being opened.

The present invention also relates to a incineration toilet comprising:

- a base;
- a toilet unit secured above the base, wherein the toilet unit comprises a toilet bowl, an incineration chamber and an ash tray,
- a toilet casing connected to the base for protecting an outside of the toilet casing against heat from the incineration chamber;

wherein the incineration toilet comprises a closable access opening through which access to the lower parts of the toilet unit is provided;

characterized in that:

- the incineration toilet comprises a locking device operable between an unlocked state in which it allows the access opening to be opened and a locked state in which the access opening is prevented from being opened, wherein the locking device is in the locked state when a heat parameter at the lower parts of the toilet unit is above a predetermined threshold value.

In one aspect, the locking device is in the unlocked state when the heat parameter at the lower parts of the toilet unit is below the predetermined threshold value. Alternatively, the locking device is in the locked state also when the heat parameter at the lower parts of the toilet unit is below the predetermined threshold value. Here, the locking device is operated to the unlocked state via a user interface etc. The user interface will only allow that the locking device is operated to the unlocked state if the heat parameter at the lower parts of the toilet unit is below the predetermined threshold value.

According to the above, the closable access opening can be open or closed. When the closable access opening is closed, there is no access to the lower parts of the toilet unit. Here, the closed access opening is protecting the outside of the incineration toilet against heat from the incineration chamber together with the toilet casing. When the closable access opening is open, access is provided to the lower parts of the toilet unit. Here, the open access opening is not protecting the outside of the incineration toilet against heat from the incineration chamber.

Due to the nature of incineration toilets, the ash tray is located below the incineration chamber, and the incineration chamber is located below the toilet bowl. Typically, the ash tray is formed as the lower part of the incineration chamber. As used herein, the term "lower parts of the toilet unit" is referring to the parts of the toilet unit being heated during the incineration process. These "lower parts of the toilet unit" will typically be the incineration chamber, the ash tray and their closest surroundings.

In one aspect, the toilet casing may be movable between a closed position and an open position relative to the base, where the access opening is defined as the opening between the toilet casing and the base when the toilet casing is in the open position.

In one aspect, the toilet casing may be in contact with the base when the toilet casing is in the closed position.

In one aspect, the toilet casing may be elevated relative to the base when the toilet casing is in the open position.

In one aspect, the toilet casing may comprise a hatch movable between a closed position and an open position relative to the toilet casing, where the access opening is defined as the opening in the toilet casing when the hatch is in the open position.

In one aspect, the hatch may be connected to the toilet casing by means of a push button snap-lock type of connector. When the hatch is in the open position, it is removed entirely away from the toilet casing. In an alternative aspect, the hatch is connected to the toilet casing by means of hinges, a flexible joint etc. When the hatch is in the open position, it is pivoted or bent away from the access opening. In yet an alternative aspect, the hatch may be formed as a drawer supported by drawer guides provided as part of the toiled casing, the base or the toilet unit.

In one aspect, the access opening is used to get access to the ash tray for emptying of the ash tray. The access opening may also be provided to perform inspection, service and/or maintenance of parts of the toilet unit In one aspect, the locking device may comprise a sensor for measuring the heat parameter at the lower parts of the toilet unit.

In one aspect, the sensor may be a temperature sensor. Alternatively, the sensor is a timer for measuring the time from the previous stop of the incineration process. This time is then used as a heat parameter representing the temperature on the inside of the toilet cover, as the expected cooling time can be predicted, calculated or found by testing. The cooling time is here the time from the previous stop of the incineration process until the time when the temperature on the inside of the toilet is below the predetermined threshold value.

In one aspect, the sensor may be connected to a control system configured to compare the temperature measured by the sensor with the predetermined threshold value.

In one aspect, the control system is the control system of the incineration toilet.

Alternatively, the control system may be a dedicated control system for the locking device, i.e. the control system is separate from the control system of the incineration toilet.

In one aspect, the locking device comprises an actuator with an actuator element movable between a first position defining the locked state and a second position defining the unlocked state.

In one aspect, the actuator is controlled by the control system.

Alternatively, the locking device may comprise a thermostatic element for moving the actuator element between the first position and the second position. The thermostatic element may comprise a bimetal element.

In one aspect, the actuator comprises a solenoid for moving the actuator element between the first position and the second position.

In one aspect, the actuator is secured to the inside of the toilet casing, wherein the actuator element is engaged to the hatch in the locked state and where the actuator element disengaged from the hatch in the unlocked state.

In one aspect, the actuator is secured to the inside of the toilet casing by means of a bracket.

In one aspect, the hatch comprises a locking aperture engaged by the actuator element in the locked state.

In one aspect, the control system is configured to:

determining whether or not the access opening is closed;

controlling the locking device to its locked state if it is determined that access opening is closed.

In one aspect, the control system is configured to:

receiving a confirmation signal from a user interface connected to the control system regarding whether the access opening is closed or not.

In one aspect, the locking device comprises a location sensor connected to the control system, wherein the control system is configured to:

receiving a confirmation signal from the location sensor regarding whether the access opening is closed or not.

In one aspect, the control system is configured to:

only allowing the incineration process to start if it is determined that the access opening is closed.

In one aspect, the control system is configured to:

receiving a request to bring the locking device to the unlocked state from the user interface;

controlling the locking device to the unlocked state if the parameter representative of the temperature on the inside of the toilet lid is below the predetermined threshold value.

According to the above, it is achieved that access to the incineration unit, and in particular to the ash tray, via the access opening prevented as long as the temperature on the inside of the toilet lid is above the predetermined threshold value. Hence, the risk of personal injuries such as burns are considerably reduced.

DETAILED DESCRIPTION

Embodiments of the invention will be described in detail below with reference to the enclosed drawings, wherein.

Figure 3A:
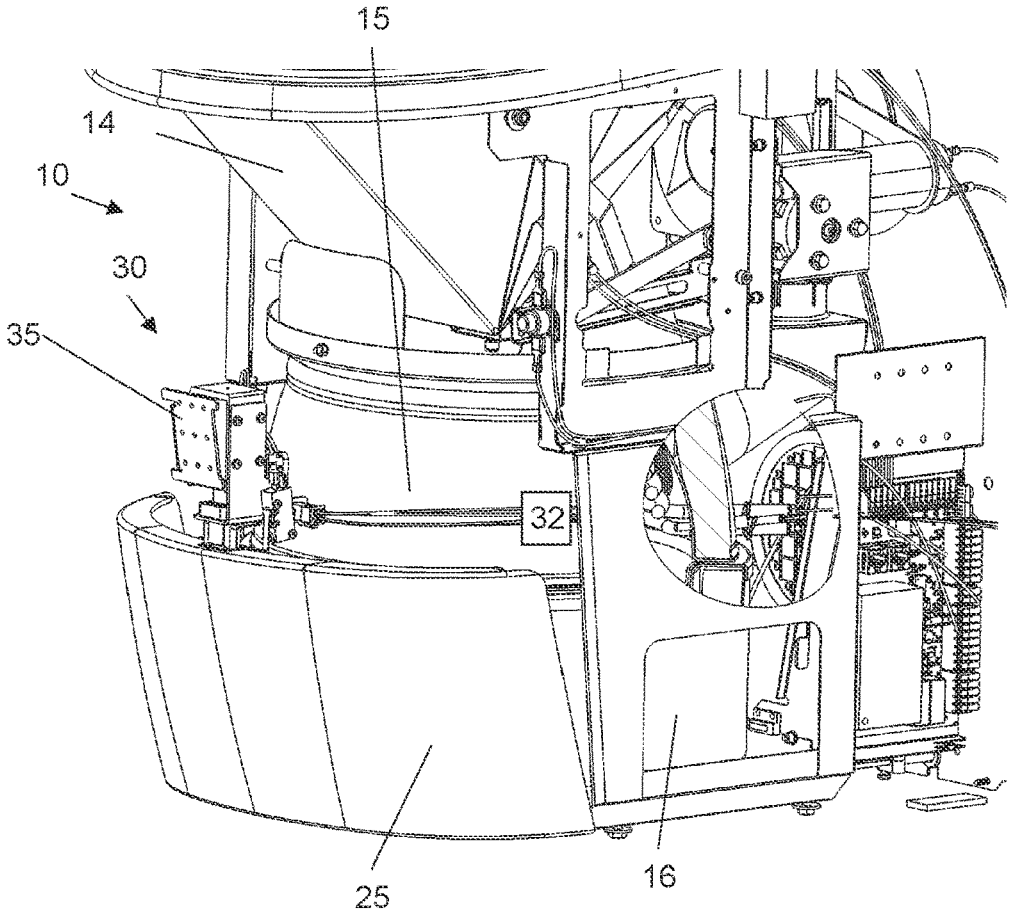
Figure 3B:
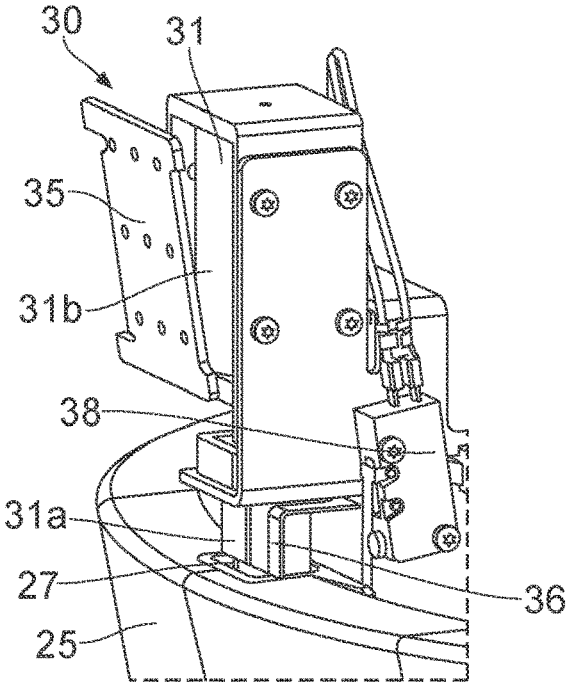
Figure 4A:
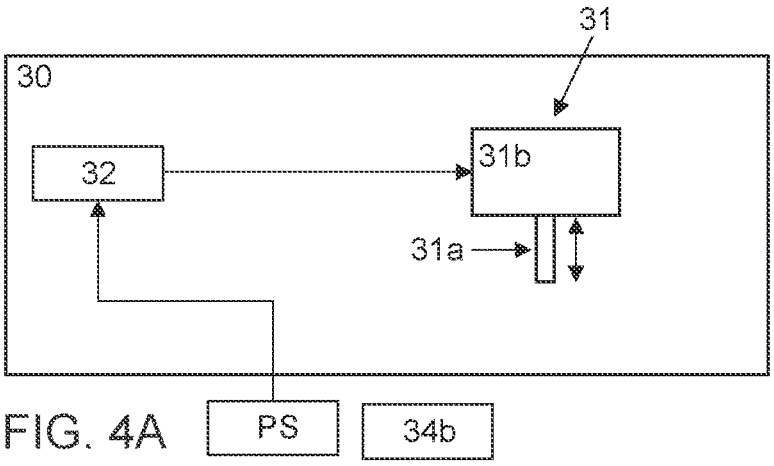
Figure 4B:
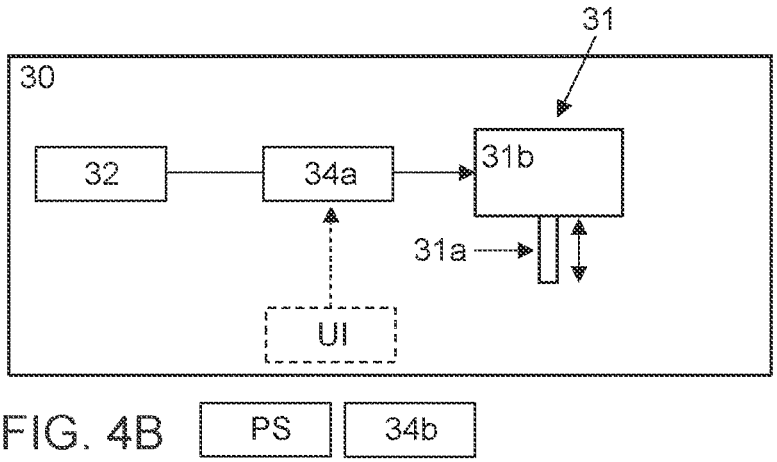
Figure 4C:
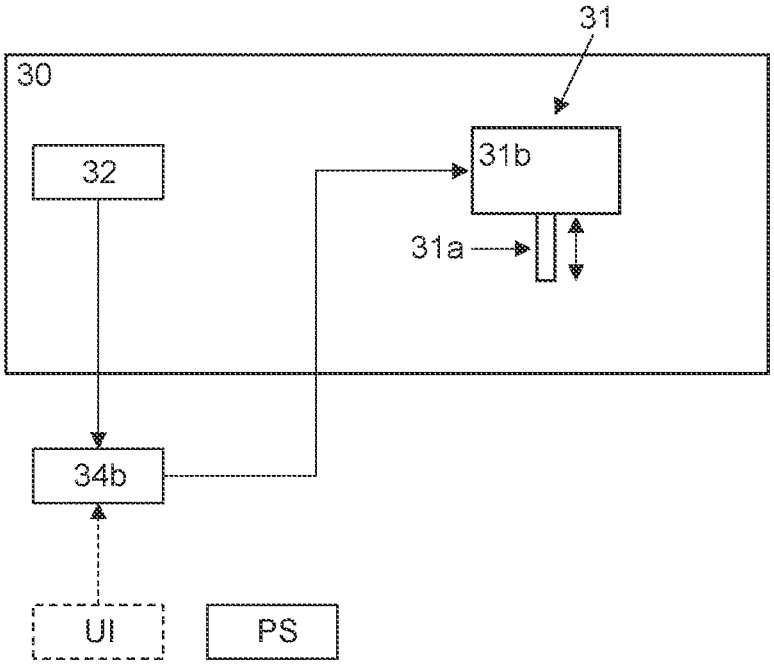

FIG. 3*a* shows an enlarged view of the toilet unit with the toilet casing (except from the hatch) being removed;

FIG. 3*b* shows an enlarged view of the actuator of the locking device;

FIG. 4*a-c* illustrates different embodiments of the locking device schematically.

Figure 5:
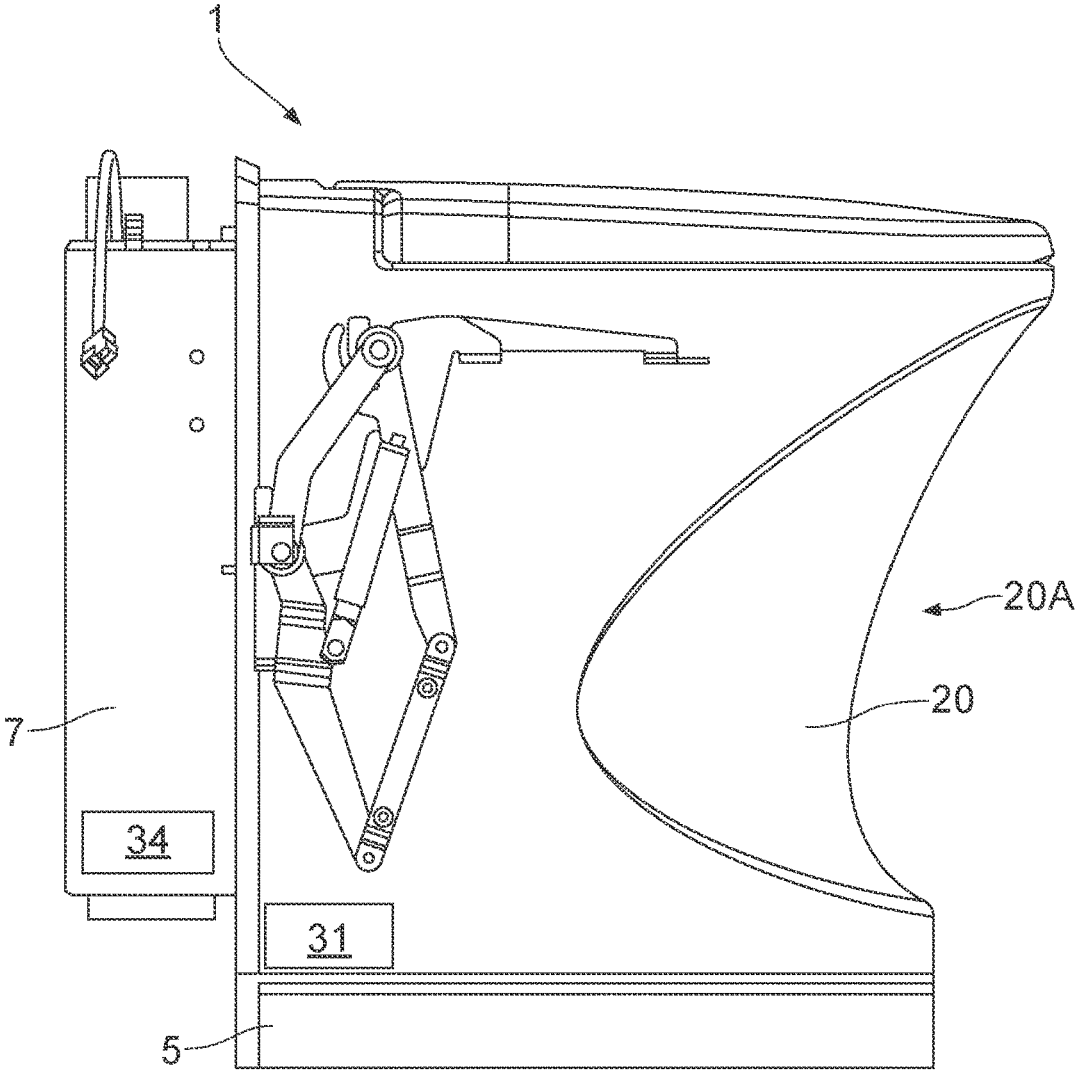
Figure 6:
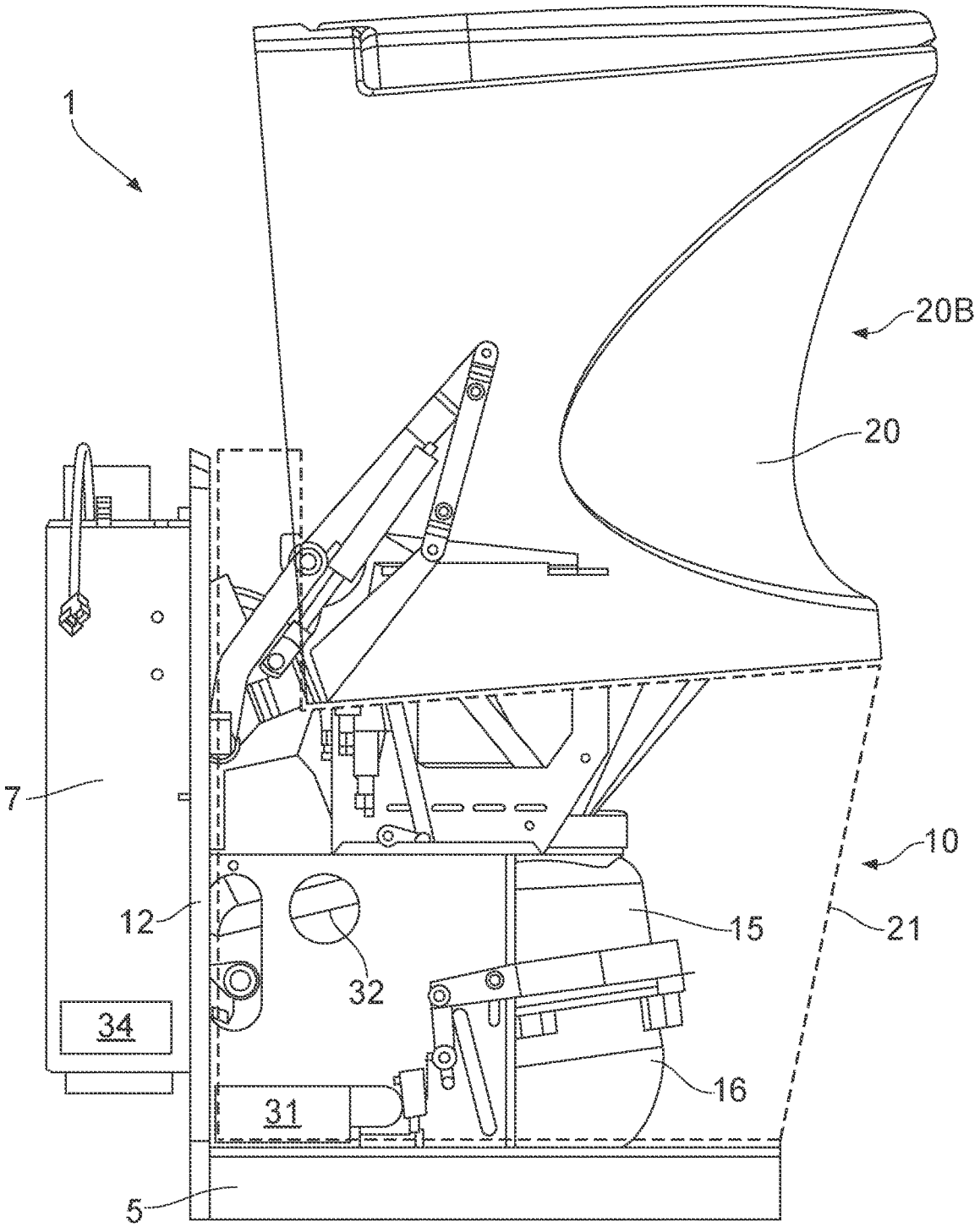
Figure 7:
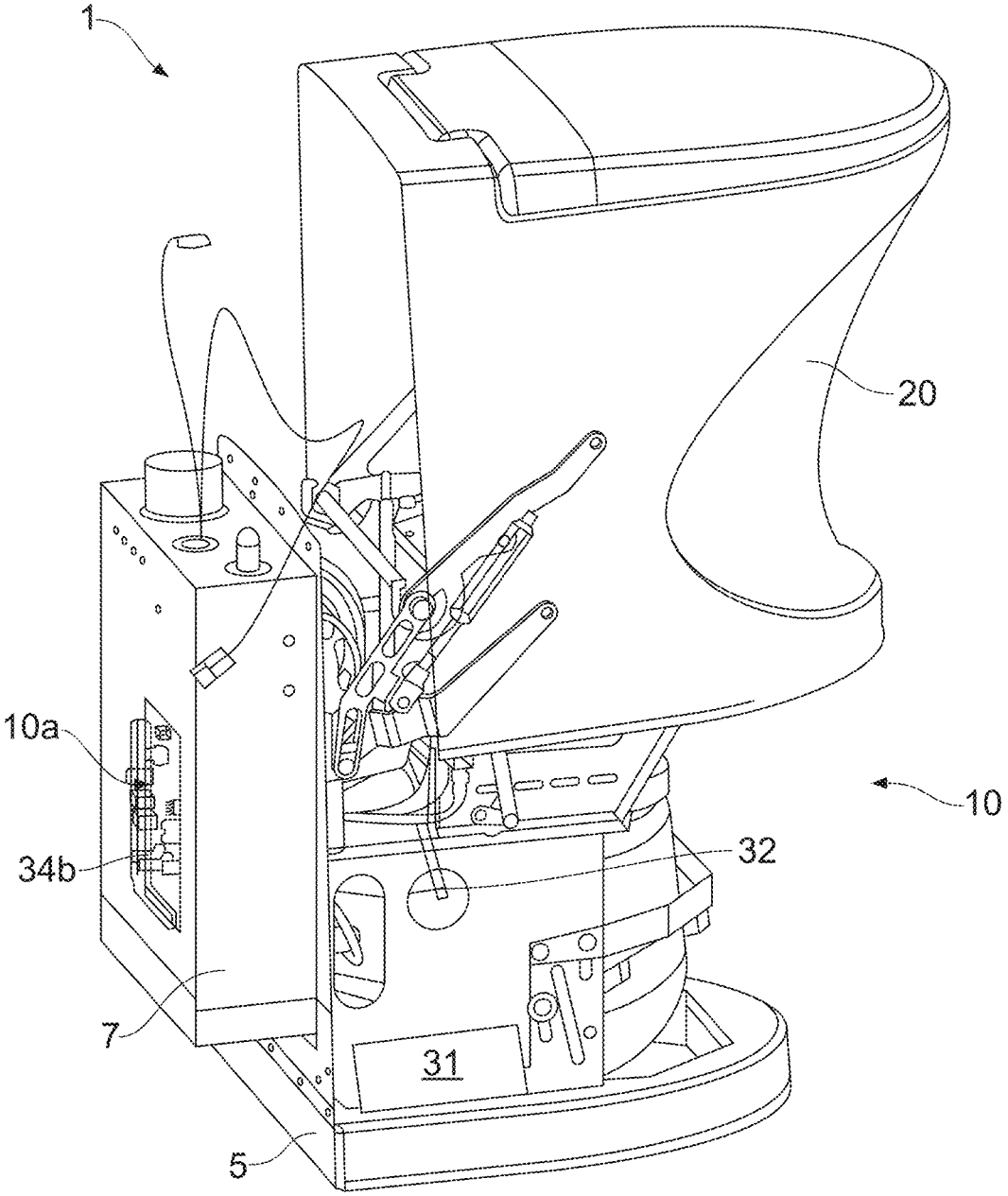

FIG. 5 illustrates a side view of a second embodiment with its toilet casing in the closed position;

FIG. 6 illustrates a side view of the second embodiment with its toilet casing in the open position;

FIG. 7 illustrates a perspective rear view of the second embodiment.

Figure 1:
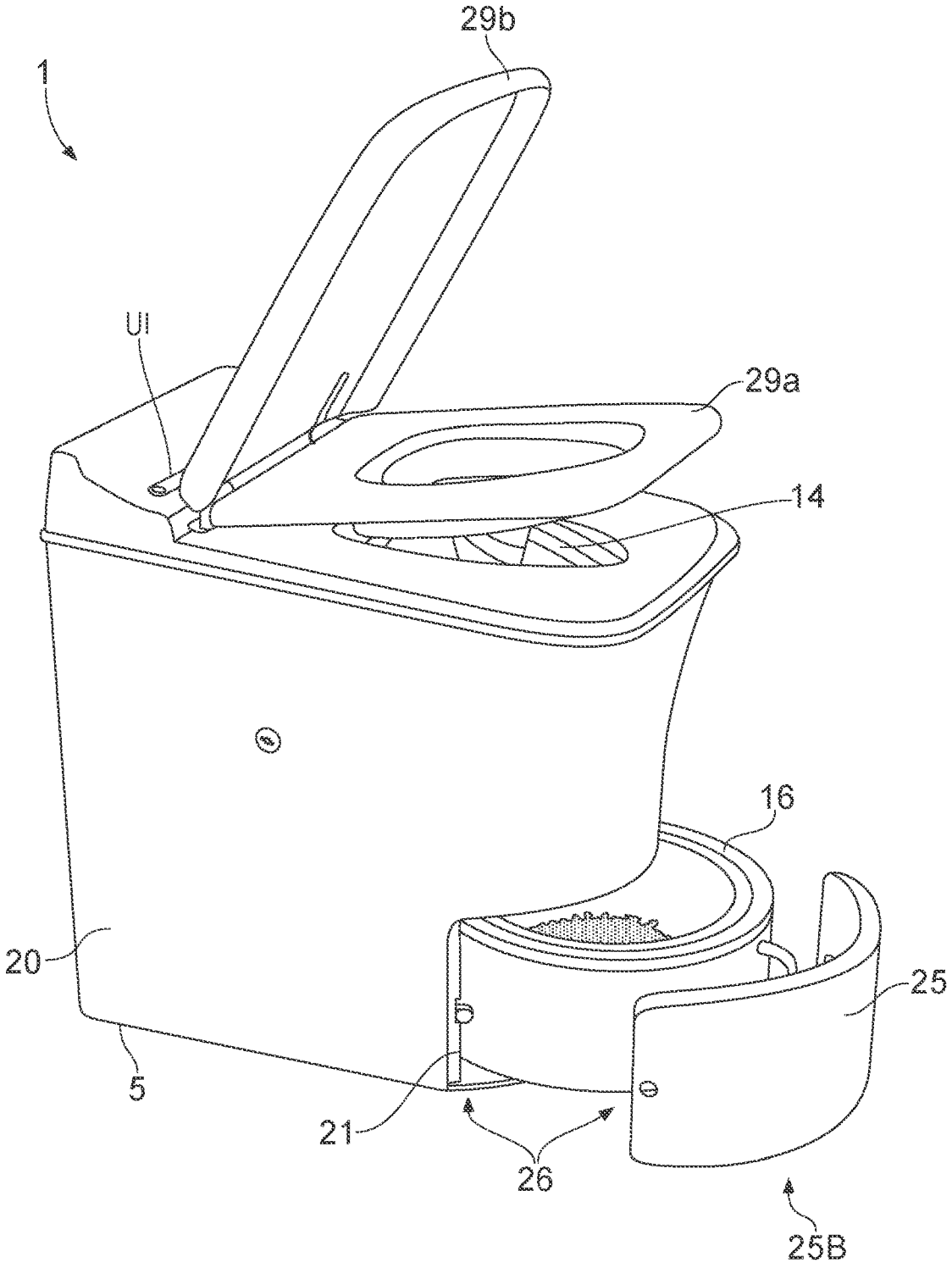
FIG. 1 (Prior Art)
FIG. 1 shows a perspective view of a prior art incineration toilet with its hatch in an open position and with the ash tray partially pulled out from its position inside the toilet casing.

It is now referred to FIG. 1, showing an incineration toilet 1 with a base 5, a toilet casing 20 and a partially open seat 29*a* and lid 29*b* around and above a toilet bowl 14. It is also shown that an access opening 21 is provided in the toilet casing 20. The incineration toilet 1 comprises a hatch 25 for opening/closing of the access opening 21. In FIG. 1, the hatch 25 is removed from the opening 21 and the ash tray 16 is pulled partially out from the access opening 21.

Figure 2:
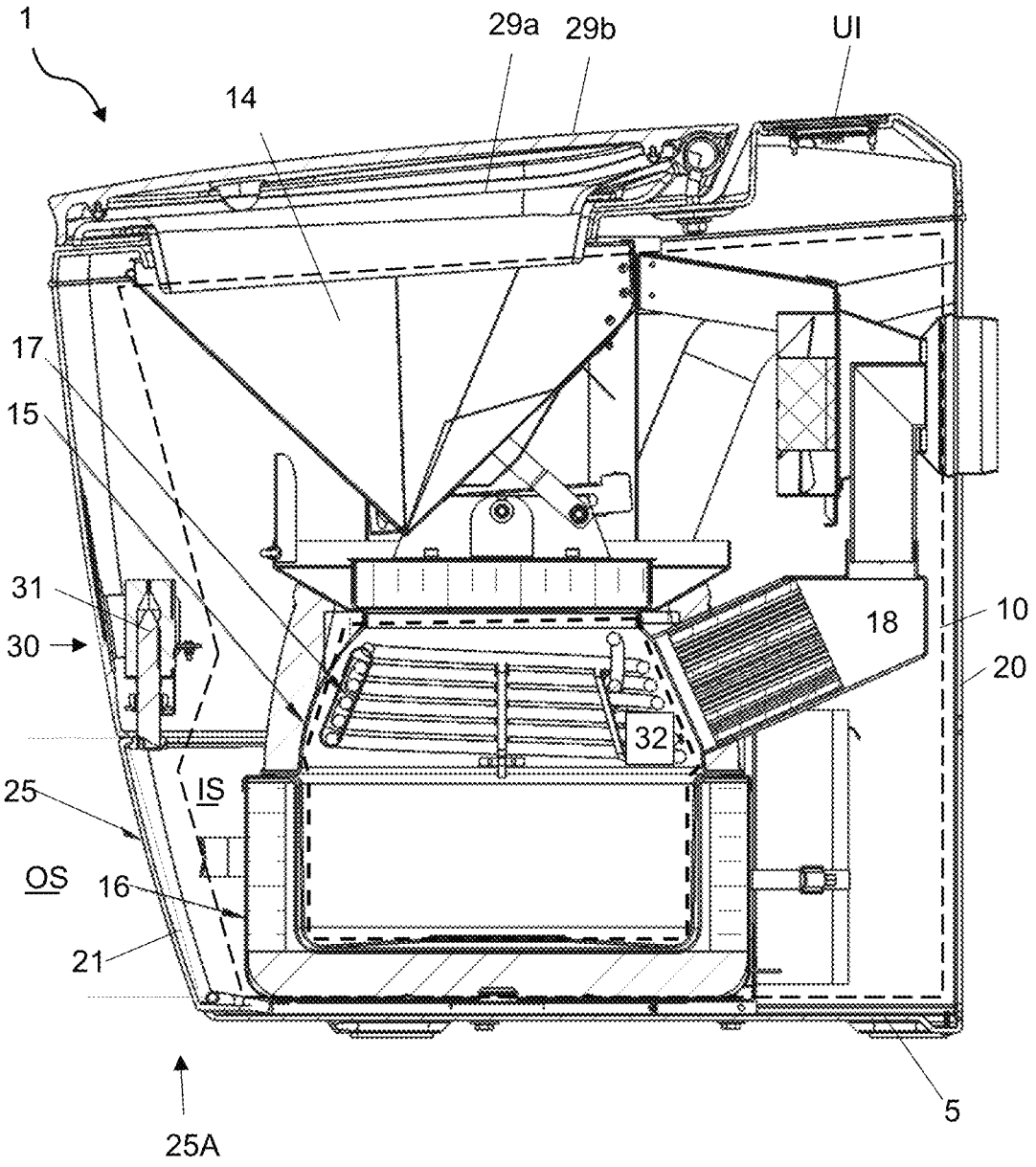
FIG. 2 shows a cross sectional side view of an embodiment of the present incineration toilet.

It is now referred to FIG. 2, where a first embodiment of the invention is shown. The incineration toilet 1 comprises a base 5, a toilet unit 10 secured to the base 5 and a toilet casing 20 connected to the base 5.

The base 5 may be similar to the prior art base 5 of FIG. 1, and its purpose is to support the toilet on the floor. Preferably, the base 5 comprises feet, to provide ventilation below parts of the base 5.

The Toilet Unit 10

The toilet unit 10 is generally shown in FIG. 2 as different parts of the toilet 1 located inside of the toilet casing 20, and the toilet unit 10 is indicated with a dashed line. The main parts of the toilet unit 10 are a toilet bowl 14, an incineration chamber 15 and an ash tray 16. The ash tray 16 may form the lower part of the incineration chamber 15. The toilet unit 10 further comprises a heater element indicated as 17. In FIG. 2, the heater element 17 is an electric heater supplied with electric energy for heating the incineration chamber 15. Alternatively, the heater element 17 may be a gas heater supplied with a combustible gas such as propane. Other energy sources may also be possible.

In addition, the toilet unit 10 comprises a ventilation system generally indicated as 18, comprising a fan and ventilation ducts for supplying the incineration chamber 15 with air and for removing waste gas from the combustion process.

It should be noted that the ventilation system has at least two purposes. One purpose is cooling, i.e. to supply cold air and remove the hot waste gas. A second purpose is to provide an odorless environment in the area around the toilet 1, by removing the waste gas. In case the heater element 17 is a gas or electric heater, the purpose of the ventilation system is to bring oxygen to the combustion process.

The toilet 1 further comprises a control system 34*b* for controlling the operation of the toilet. The control system 34*b* may comprise sensors and actuators.

It should be noted that also the gas heated incineration toilet 1 is connected to an electric power supply PS for supplying electric power to the control system 34*b* and to the fan of the ventilation system.

It should be noted that the toilet bowl 14, the incineration chamber 15, the ash tray 16, the heater element 17 and the ventilation system 18 are considered known from prior art incineration toilets and will not be described in detail herein.

The Toilet Casing 20

The toilet casing 20 is connected to the base 5, either directly or via the toilet unit 10. As mentioned in the introduction above, the purpose of the toilet casing 20 is to insulate the toilet towards the surroundings, for example to prevent people from touching the hot parts of the toilet unit, to prevent combustible materials to unintentionally come into contact with the hot parts of the toilet unit etc. The toilet casing provides in addition a better esthetic appearance.

The seat 29*a* and lid 29*b* above the toilet bowl 14 may be considered as parts of the toilet casing 20 or may be considered as separate parts connected to the toilet casing 20.

The user interface UI may be integrated in the toilet casing 20 or provided exterior of the incineration toilet and connected to the incineration toilet by wire or wirelessly. The UI may be provided in communication with the control system for controlling the operation of the toilet.

The incineration toilet further comprises a closable access opening 21 through which access to the lower parts of the toilet unit 10 is provided. In particular, the access opening 21 is providing access to the ash tray 16, in order to empty the ash tray 16 periodically.

In FIG. 2, the access opening 21 is an opening provided in the toilet casing 20. The access opening 21 is closed by a hatch 25. The hatch 25 is movable between a closed position 25A (FIG. 2) and an open position 25B (FIG. 1) relative to the toilet casing 20. The hatch 25 may be connected to the toilet casing 20 by means of a push button snap-lock type of connector 26 (FIG. 1), magnets etc.

When the closable access opening 21 is closed, there is no direct access to the lower parts of the toilet unit 10 and the outside OS of the incineration toilet 1 is protected against heat from the incineration chamber 15. When the closable access opening 21 is open, access is provided to the lower parts of the toilet unit 10. When the closable access opening 21 is open, access is provided to the lower parts of the toilet unit 10, in particular to the ash tray 16.

The Locking Device 30

In FIG. 2, it is shown that the incineration toilet 1 further comprises a locking device or locking system 30. The locking device 30 is configured to have two states, an unlocked state in which it allows the access opening 21 to be opened and a locked state in which the access opening 21 is prevented from being opened.

It is now referred to FIG. 3*a* and FIG. 3*b*. Here, it is shown that the locking device 30 comprises an actuator 31 with an actuator element 31*a* movable between a first position defining the locked state and a second position defining the unlocked state. The actuator element 31 is here a rod moved linearly by a solenoid 31*b*. The solenoid 31*b* is secured to the inside of the toilet housing 20 by means of a bracket 35. The actuator element 31 is engaged with a locking aperture 27 of the hatch 25 in the locked state and is moved to a position in which it is not engaged with the locking aperture 27 in the open state.

The actuator 31 may be an electromagnet acting on the actuator element 31*a*. The actuator element 31*a* may be spring loaded, so that the electromagnet may be in an off position when the actuator 31 is in the lower position (released spring position), referred to as the locked state. In the event the cover 20,25 is inserted to cover the access opening 21, the cover 20,25 will push the spring-loaded actuator element 31*a* such that it engages the locking aperture 27 on the cover 20,25. The locking system is thus in the locked state, and this may be the normal state during use and standby.

Hence, the locking system 30 is here brought from the unlocked state to the locked state by user interaction.

The system may comprise a location sensor/switch for reading the locked state and that the cover 20,25 is in the locked position. The sensor/switch 38 may be activated by a spring 36 being compressed by the cover in the event the cover is in position covering the access opening 21.

In the event access through the access opening 21 is desired, the control system reads (checks) whether the temperature in the incineration chamber and/or the lower parts of the incineration toilet is below the threshold value so that there is no danger of burns by touching the ash tray. If the temperature is below the threshold value, the use may be allowed to open the cover 20,25 by indicating on a button or via a control panel.

The electromagnet may have a pulse of about one second and attract the actuator element 31*a* vertically, or substantially vertically, so that it can be released from cooperation with the recess or locking aperture 27. The spring 36 is tensioned towards the cover 20,25 and will push the cover 20,25 outwards in the event the cover 20,25 is released from engagement with the actuator element 27. The cover 20,25 may remain in a semi-open position (i.e., by a spring or magnet) so that the actuator element 31*a* is prevented to return to engagement with the opening or locking aperture 27 on the cover 20,25.

In embodiment, the sensor/switch 38 reads the position of the cover 20,25 via the spring 36 and sends the information to the control system indicating the locked or unlocked state of the locking system. Thus, in the event the cover 20,25 is installed in a position covering the access opening, the sensor/switch 38 will be activated by the cover pushing the spring 36 of the sensor/switch 38 backwards or inwards.

In FIG. 3*a*, it is shown that the locking device 30 further comprises a temperature sensor 32 for measuring a heat temperature representative of the temperature of the lower part of the toilet unit 10. The temperature sensor 32 is provided in communication with the locking device 30, either directly (as shown in FIG. 4*a*) or via a dedicated control system 34*a* (as shown in FIG. 3*b*) or via the control system 34*b* for controlling the incineration toilet 1 (as shown in FIG. 3*c*).

The locking device 30 is controlled to be in the locked state when a heat parameter at the lower parts of the toilet unit 10 is above a predetermined threshold value. The locking device 30 is further controlled to be in the open state when the heat parameter at the lower parts of the toilet unit 10 is below the predetermined threshold value.

In FIG. 4*a*, the temperature sensor 32 may be a thermostat, for controlling a connection between the actuator 30 and the power supply PS on/off based on the temperature.

In FIG. 4*b*, temperature sensor 32 may be a semiconductor type of sensor, or other types of sensors provided in communication with the dedicated control system 34*a*. The dedicated control system 34*a* may comprise a digital signal processor configured to compare the temperature measured by the sensor 32 with the predetermined threshold value.

A user interface indicated as UI may be connected to the dedicated control system 34*a*. It should be noted that this user interface UI typically will be a dedicated user interface for the control of the locking device 30.

In FIG. 4*c*, the control system 34*b* is shown outside of the locking device 30 and the control system 34*b* is here also used to control the operation of other parts of the toilet 1. The user interface UI of the toilet (shown in FIGS. 1 and 2) is typically connected to this control system 34*b*.

It should be noted that the actuator 31, the control system 34*a*, 34*b* and possibly also the temperature sensor 32 of FIGS. 4*b* and 4*b* will be powered by the power supply PS. However, the connection of power supply PS to the respective parts of the locking device 30 has not been indicated in these drawings.

Below, the dedicated control system 34*a* and the control system 34*b* for controlling the incineration toilet 1 are commonly referred to as "control system 34".

The control system 34 may be configured to check if the access opening 21 is open or closed, before controlling the locking device 30 from the unlocked state to the locked state, as in some embodiments, a locked locking device 30 will prevent closing of the access opening.

This function may be achieved by requesting the user to confirm that the access opening is closed via the user interface UI. Alternatively, the locking device 30 may comprise a location sensor 38 (shown in FIG. 3*b*) to detect whether or not the access opening is closed.

When a confirmation signal has been received from the user interface UI or if the location sensor 38 indicates that the access opening is closed, the control system 34 may control the locking device 30 from the unlocked state to the locked state.

The control system 34 may also be configured to only allow the incineration process to start if it is determined that the access opening 21 is closed and that the locking device 30 is in the locked state.

The control system 34 may also be configured to receive a request to bring the locking device 30 to the unlocked state from the user interface UI, and then controlling the locking device 30 to the unlocked state if the parameter representative of the temperature in the lower part of the toilet unit 1 is below the predetermined threshold value. Hence, here the user must use the user interface UI to unlock the locking device 30 in order to open the access opening.

Alternative Embodiments

In the embodiment above, the access opening 21 is opened and closed by means of a hatch 25.

It is now referred to FIGS. 5, 6 and 7, wherein a second embodiment is shown. Here, the toilet casing 20 is movable between a closed position 20A and an open position 20B relative to the base 5, where the access opening 21 is defined as the opening between the toilet casing 20 and the base 5 when the toilet casing 20 is in the open position 20B.

In FIG. 5, the closed position 20A is shown. Here, the toilet casing 20 is in contact with the base 5.

In FIG. 6, the open position is shown. Here, the toilet casing 20 is elevated relative to the base 5. Here, not only the ash tray is accessible, but also other parts of the toilet unit 10. Hence, the access opening can also be used for inspection, service and/or maintenance of other parts of the toilet unit 10.

It should be noted that this embodiment of the toilet 1 comprises a back cover 7. Inside of the back cover 7 parts of the toilet unit is located, as indicated as 10*a* in FIG. 7. Here, parts of the ventilation system and also the control system 34 can be provided.

The back cover 7 may be defined as part of the base 5, where the toilet casing 20 is elevated relative to the base 5. Alternatively, the back cover 7 can be defined as a part of the toilet casing 20. Here, parts of the toilet casing 20 is elevated relative to the base 5 and relative to the back cover 7 of the toilet casing 20.

In an alternative embodiment, the locking device 30 comprises an actuator in the form of a thermostatic element for moving the actuator element 31*a* between the first position and the second position. The thermostatic element may comprise a bimetal element. In such an embodiment, the locking device 30 does not require a power supply PS.

The invention claimed is:

1. An incineration toilet comprising:

a base;

a toilet unit secured above the base, wherein the toilet unit comprises a toilet bowl, an incineration chamber, and an ash tray;

a seat and a lid around and above the toilet bowl;

a toilet casing connected to the base for protecting an outside of the toilet casing against heat from the incineration chamber;

an access opening in the toilet casing through which access to the ashtray is provided for emptying of the ash tray;

a cover for closing off the access opening;

a locking system operable between an unlocked state in which the cover is allowed to be opened and a locked state in which the cover is prevented from being opened; and a control system for automatically operating the locking system from the locked state to the unlocked state based on a heat parameter, such that the locking system is in the unlocked state when the heat parameter is below a predetermined threshold value.

2. The incineration toilet according to claim 1, wherein the locking system comprises at least any one of a:

heat sensor for measuring the heat parameter and/or a timer for calculating the heat parameter.

3. The incineration toilet according to claim 2, wherein the control system is receiving information about the state of the locking system from a sensor.

4. The incineration toilet according to claim 2, wherein the heat sensor is measuring the temperature inside the incineration chamber.

5. The incineration toilet according to claim 2, wherein the timer is calculating the temperature at the lower parts of the toilet unit based on time elapsed since last incineration and a cooling time of the incineration chamber.

6. The incineration toilet according to claim 5, wherein the heat sensor and/or the timer is connected to the control system configured to compare the temperature measured by the heat sensor and/or the timer with the predetermined threshold value.

7. The incineration toilet according to claim 4, wherein the locking system comprises an actuator with an actuator element movable between a first position defining the locked state and a second position defining the unlocked state.

8. The incineration toilet according to claim 7, wherein the actuator is controlled by the control system.

9. The incineration toilet according to claim 7, wherein the actuator is secured to inside of the toilet casing or to the toilet unit, wherein the actuator element is engaged to the cover in the locked state and where the actuator element disengaged from the cover in the unlocked state.

10. The incineration toilet according to claim 2, wherein the locking system comprises a bimetal device adapted to change in curvature, or bending, in response to temperature change.

11. The incineration toilet according to claim 1, wherein the cover is a section of the toilet casing.

12. The incineration toilet according to claim 1, wherein the cover is a hatch for closing the access opening.

* * * * *